US006513509B1

(12) United States Patent
Matsumoto

(10) Patent No.: US 6,513,509 B1
(45) Date of Patent: Feb. 4, 2003

(54) DEVICE FOR CONTROLLING THE AIR-FUEL RATIO OF AN INTERNAL COMBUSTION ENGINE

(75) Inventor: Norio Matsumoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 225 days.

(21) Appl. No.: 09/714,537

(22) Filed: Nov. 17, 2000

(30) Foreign Application Priority Data

Jun. 7, 2000 (JP) ..... 2000-170504

(51) Int. Cl.[7] ..... F02D 41/00
(52) U.S. Cl. ..... 123/674; 701/109
(58) Field of Search ..... 123/674; 701/109

(56) References Cited

U.S. PATENT DOCUMENTS 6,076,037 A * 6/2000 Ono et al. ..... 123/674
6,161,530 A * 12/2000 Kakizaki et al. ..... 123/674
6,283,106 B1 * 9/2001 Kadowaki et al. ..... 123/674
6,397,830 B1 * 6/2002 Dohta ..... 123/674

FOREIGN PATENT DOCUMENTS

JP 59-54750 3/1984
JP 60-98150 6/1985

* cited by examiner

*Primary Examiner*—John Kwon
(74) *Attorney, Agent, or Firm*—Sughrue Mion, PLLC

(57) ABSTRACT

A device for controlling the air-fuel ratio of an internal combustion engine, which is capable of highly precisely finding learning correction values in an open-loop operation region by using an ordinary air-fuel ratio sensor. The device comprises means 22 for correcting the amount of fuel depending upon a target air-fuel ratio AFo, means 23 for determining the conditions CF for controlling the air-fuel ratio feedback of the internal combustion engine depending upon the operation conditions, means 24 for controlling the air-fuel ratio feedback in the feedback operation region, and means 25 for finding learning correction values Zs for every operation region based on the control quantity AFc of the feedback control means, wherein the feedback control operation is executed in the open-loop operation region, and the learning correction values in the open-loop operation region are found during the feedback control operation that lasts only temporarily.

9 Claims, 6 Drawing Sheets

DEVICE FOR CONTROLLING THE AIR-FUEL RATIO OF AN INTERNAL COMBUSTION ENGINE

BACKGROUND OF THE INVENTION

1. Field of the Invention

The present invention relates to a device for controlling the air-fuel ratio of an internal combustion engine, which feeds, to the internal combustion engine, the fuel in an amount that meets the operation condition of the engine by using a signal detected by an air-fuel ratio sensor. More specifically, the invention relates to a device for controlling the air-fuel ratio of an internal combustion engine, which is capable of highly precisely finding learning correction values in an open-loop operation region without executing the air-fuel ratio feedback control operation, by using an air-fuel ratio sensor constituted by an ordinary oxygen sensor.

2. Prior Art

In a device for controlling the air-fuel ratio of an internal combustion engine, in general, a target air-fuel ratio is set depending upon operation condition data from various sensors (air-flow sensor that measures the amount of the air taken in, etc.), and the amount of fuel injection is so corrected that the practical air-fuel ratio comes into agreement with the target air-fuel ratio (usually, stoichiometric air-fuel ratio $\lambda$=14.7).

In the device for controlling the air-fuel ratio of an internal combustion engine, further, an air-fuel ratio sensor (also called "oxygen sensor") is usually disposed in the exhaust pipe to detect the stoichiometric air-fuel ratio while learning and correcting the air-fuel ratio feedback control quantity in order to compensate for a change caused by aging and dispersion of various parts constituting the sensors and the fuel-feeding system.

FIG. 5 is a diagram schematically illustrating the constitution of a conventional device for controlling the air-fuel ratio of an internal combustion engine.

In FIG. 5, an intake pipe 2 of an engine 1 constituting the main body of the internal combustion engine is provided with a throttle valve 3 for adjusting the amount of the air taken in, and a throttle opening-degree sensor 4 for measuring the opening degree $\theta$ of the throttle valve 3 is coupled to the throttle valve 3.

An air-flow sensor 5 is provided on the upstream side of the throttle valve 3 in the intake pipe 2, and an injector 6 is provided in the intake pipe 2 on the downstream side of the throttle valve 3 to inject fuel in a required amount.

The air-flow sensor 5 measures the flow rate of the air in the intake pipe 2 as the intake air amount Qa taken in by the engine 1.

A combustion chamber 7 in each cylinder of the engine 1 is constituted by a cylinder block 8 and a piston 9 that reciprocates in the cylinder block.

The combustion chamber 7 is provided with a spark plug 10, an intake valve and an exhaust valve 12.

The combustion chamber 7 is connected to an exhaust pipe 13. An air-fuel-ratio sensor 14 which is an oxygen sensor is disposed in the exhaust pipe 13.

The air-fuel-ratio sensor 14 produces an air-fuel ratio corresponding to the stoichiometric air-fuel ratio $\lambda$.

Data (throttle opening degree $\theta$, intake air amount Qa, air-fuel ratio signal AF) detected by the sensors 4, 5 and 14 and representing the operation conditions of the engine 1 are input to a control circuit 20 which is a microcomputer.

Though not diagramed, the control circuit 20 includes a well-known CPU, RAM and ROM connected to the CPU through a bidirectional bus, as well as input ports and output ports.

The control circuit 20 includes air-fuel ratio correction means for correcting the air-fuel ratio so as to accomplish a target air-fuel ratio depending upon the operation conditions, feedback control condition-determining means for determining the conditions for controlling the feedback of air-fuel ratio to the engine 1 depending upon the operation conditions, feedback control means for bringing the air-fuel ratio of the engine 1 into agreement with the target air-fuel ratio when the control conditions are permitted, and air-fuel ratio learning means for learning and correcting the air-fuel ratio feedback control quantity. The control circuit 20 controls the amount of fuel injected through the injector 6 based upon the operation conditions and the air-fuel ratio signal AF.

To the input ports of the control circuit 20 are connected the throttle opening-degree sensor 4, air-flow sensor 5, air-fuel ratio sensor 14, as well as various other sensors (rotation sensor for detecting the rotational speed of the engine, cooling water temperature sensor, etc.) that are not shown.

The control circuit 20 processes various input data (operation conditions) to obtain control data of the engine 1, and produces, through the output ports thereof, injection signals J for the injectors 6, ignition signals G for the spark plugs 10, as well as drive signals for various other actuators that are not shown.

Next, the operation of the conventional device for controlling the air-fuel ratio of an internal combustion engine shown in FIG. 5 will be concretely described with reference to FIG. 6.

FIG. 6 is a diagram schematically illustrating learning correction values obtained by using a conventional device for controlling the air-fuel ratio of an internal combustion engine disclosed in Japanese Examined Patent Publication (Kokoku) No. 56340/1987.

FIG. 6 illustrates learning correction values ZC0 to ZC9 in plural operation regions to where the air-fuel ratio feedback control is applied, and in which the abscissa represents the engine rotational speed Ne [r/min], the ordinate represents filling efficiency EC [%] corresponding to the intake air amount Qa, i.e., represents the engine load.

The feedback operation regions are sectionalized by the engine rotational speeds NC0 to NC2 and the engine loads EC0 to EC2.

The learning correction values ZC0 to ZC9 in the operation regions of FIG. 6 are obtained by sampling the air-fuel ratio feedback control quantities among the predetermined ignition cycles, and are periodically updated at every update timing when the sampling is finished.

In FIG. 5, first, the control circuit 20 operates the target air-fuel ratio and the target ignition timing based on the operation condition data from various sensors, and produces injection signals J for the injectors 6 and ignition signals G for the spark plugs 10.

Therefore, the injector 6 is driven just before the intake stroke of the engine 1 to inject fuel, whereby the mixture gas containing fuel is taken into the combustion chamber 7 when the throttle valve 3 is opened, so that the interior of the combustion chamber is uniformly filled with the mixture gas.

The spark plug 10 is energized near the compression stroke of the engine 1 to ignite the mixture gas in the combustion chamber 7, whereby the engine 1 produces a drive torque as a result of combustion.

On the other hand, feedback control means in the control circuit 20 executes the air-fuel feedback control operation when the condition for controlling the air-fuel ratio feedback is established depending upon the operation conditions of the engine 1.

At this moment, the feedback control means operates the control quantity based upon the operation conditions and the air-fuel ratio signal AF from the air-fuel ratio sensor 14, and so controls the feedback that the practical air-fuel ratio is brought into agreement with the target air-fuel ratio.

Thus, the air-fuel ratio of the engine 1 is controlled to accomplish a target value, whereby the catalytic converter (not shown) for purifying the exhaust gases disposed in the exhaust pipe 13 purifies the exhaust gases to a sufficient degree preventing the emission of non-purified gases.

Further, the amount of controlling the fuel (air-fuel ratio) is corrected not only by the air-fuel ratio signals AF but also by the learning correction values ZC0 to ZC9 in the operation regions of FIG. 6 depending upon the operation regions, whereby the air-fuel ratio of the engine 1 is highly precisely controlled to acquire a target air-fuel ratio.

When it is desired to obtain a large output torque for rapid acceleration or to obtain cooling effect in a high-speed operation region, on the other hand, the amount of fuel is increased to enrich the air-fuel ratio of the engine 1 (to render the air-fuel ratio to be smaller than the stoichiometric air-fuel ratio). Therefore, feedback control for changing the stoichiometric air-fuel ratio $\lambda$ to the target value is inhibited, and the open-loop operation is carried out.

In the open-loop operation region, the learning correction values are not operated. Therefore, the correction control operation is executed by using learning correction values (ZC3, ZC6, ZC7 to ZC9, etc. in FIG. 6) in the feedback (closed-loop) operation region close to the open-loop operation region.

However, since they are not the learning correction values in the practical open-loop operation region, it is not allowed to highly precisely control the air-fuel ratio in the open-loop operation region.

Further, in a conventional device disclosed in, for example, Japanese Examined Patent Publication (Kokoku) No. 56499/1990, the EGR inhibition region is set in the feedback operation region close to the open-loop operation region, and the learning correction values fed back in the EGR inhibition region are used in the open-loop operation region.

In this case, too, however, the operation conditions of the engine 1 are different from those of the practical open-loop operation region, and the air-fuel ratio cannot be highly precisely controlled.

In the conventional device for controlling the air-fuel ratio of an internal combustion engine as described above, the learning correction values in the feedback (closed-loop) operation region are used as learning correction values in the open-loop operation region, involving a problem in that a highly precisely enriched air-fuel ratio cannot be obtained due to dispersion in the engine 1 and in various control equipment.

Besides, when the air-fuel ratio being controlled is enriched to an excess degree due to dispersion in the air-fuel ratio in the open-loop operation region, properties of the exhaust gases are deteriorated. Conversely, when the air-fuel ratio is not enriched to a sufficient degree, the catalytic converter is damaged.

Further, the cost is driven up when it is attempted to use, for example, a linear air-fuel ratio sensor in order to highly precisely control the enriched air-fuel ratio in the open-loop operation region.

SUMMARY OF THE INVENTION

The present invention was accomplished in order to solve the above-mentioned problems, and its object is to provide a device for controlling the air-fuel ratio of an internal combustion engine, which is capable of highly precisely finding the learning correction values in the open-loop operation region by using an air-fuel-ratio sensor which is an ordinary oxygen sensor.

The present invention is concerned with a device for controlling the air-fuel ratio of an internal combustion engine comprising:

- an injector for injecting the fuel of a required amount into an internal combustion engine;
- an air-fuel-ratio sensor which is an oxygen sensor installed in an exhaust pipe of the internal combustion engine for detecting the stoichiometric air-fuel ratio; and
- a control circuit for controlling the injector based upon the operation conditions of the internal combustion engine and the air-fuel-ratio signal from the air-fuel-ratio sensor;

wherein the control circuit includes:

- air-fuel-ratio correction means for correcting the amount of fuel depending upon a target air-fuel ratio that varies according to the operation conditions;
- feedback control condition-determining means for determining the conditions for controlling the air-fuel ratio feedback of the internal combustion engine depending upon the operation conditions;
- feedback control means for so controlling the air-fuel ratio of the internal combustion engine as to come into agreement with the target air-fuel ratio in the feedback operation region where the control conditions are permitted; and
- air-fuel-ratio learning means for finding learning correction values for every operation region based on the control quantity of the feedback control means;
- wherein in the open-loop operation region where the control conditions are not permitted, the feedback control means temporarily executes a feedback control operation, and the air-fuel-ratio learning means finds learning correction values in the open-loop operation region during feedback control period that lasts only temporary.

In the device for controlling the air-fuel ratio of an internal combustion engine according to the invention, the air-fuel-ratio learning means changes the number of times of sampling for finding the learning correction values depending upon the feedback operation region and the open-loop operation region.

In the device for controlling the air-fuel ratio of an internal combustion engine according to the invention, the air-fuel-ratio learning means sets the number of times of sampling for finding the learning correction values in the open-loop operation region to be smaller than the number of times of sampling for finding the learning correction values in the feedback operation region.

In the device for controlling the air-fuel ratio of an internal combustion engine according to the invention, the feedback control means changes the proportional coefficient and integration coefficient of the control quantity depending upon the feedback operation region and the open-loop operation region.

In the device for controlling the air-fuel ratio of an internal combustion engine according to the invention, the feedback control means sets the proportional coefficient and the integration coefficient in the open-loop operation region to be larger than the proportional coefficient and the integration coefficient in the feedback operation region.

In the device for controlling the air-fuel ratio of an internal combustion engine according to the invention, the air-fuel-ratio learning means has filter operation means for executing the filtering every time when the learning correction value is updated.

In the device for controlling the air-fuel ratio of an internal combustion engine according to the invention, the air-fuel ratio learning means changes the filtering coefficient of the filter operation means depending upon the feedback operation region and the open-loop operation region.

In the device for controlling the air-fuel ratio of an internal combustion engine according to the invention, the air-fuel-ratio learning means sets the filter coefficient in the open-loop operation region to be larger than the filter coefficient in the feedback operation region.

In the device for controlling the air-fuel ratio of an internal combustion engine according to the invention, the air-fuel-ratio learning means divides the open-loop operation region into plural regions depending upon the rotational speed and load of the internal combustion engine, and sets the learning correction values for the divided regions.

DESCRIPTION OF THE PREFERRED EMBODIMENTS

Embodiment 1.

An embodiment 1 of the present invention will now be described in detail with reference to the drawings.

Figure 1:
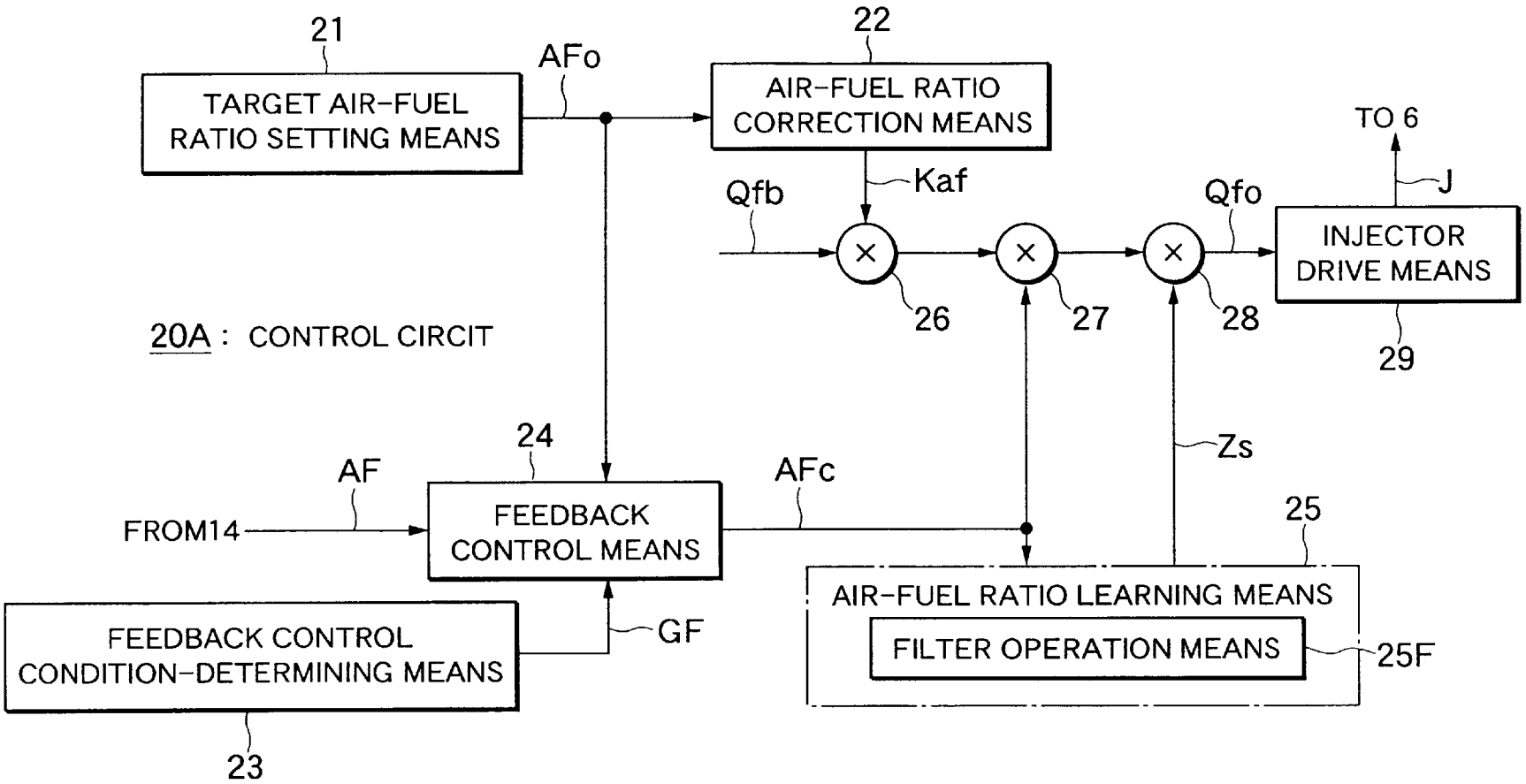
FIG. 1 is a functional block diagram schematically illustrating major portions of a control circuit according to an embodiment 1 of the present invention.
Figure 5:
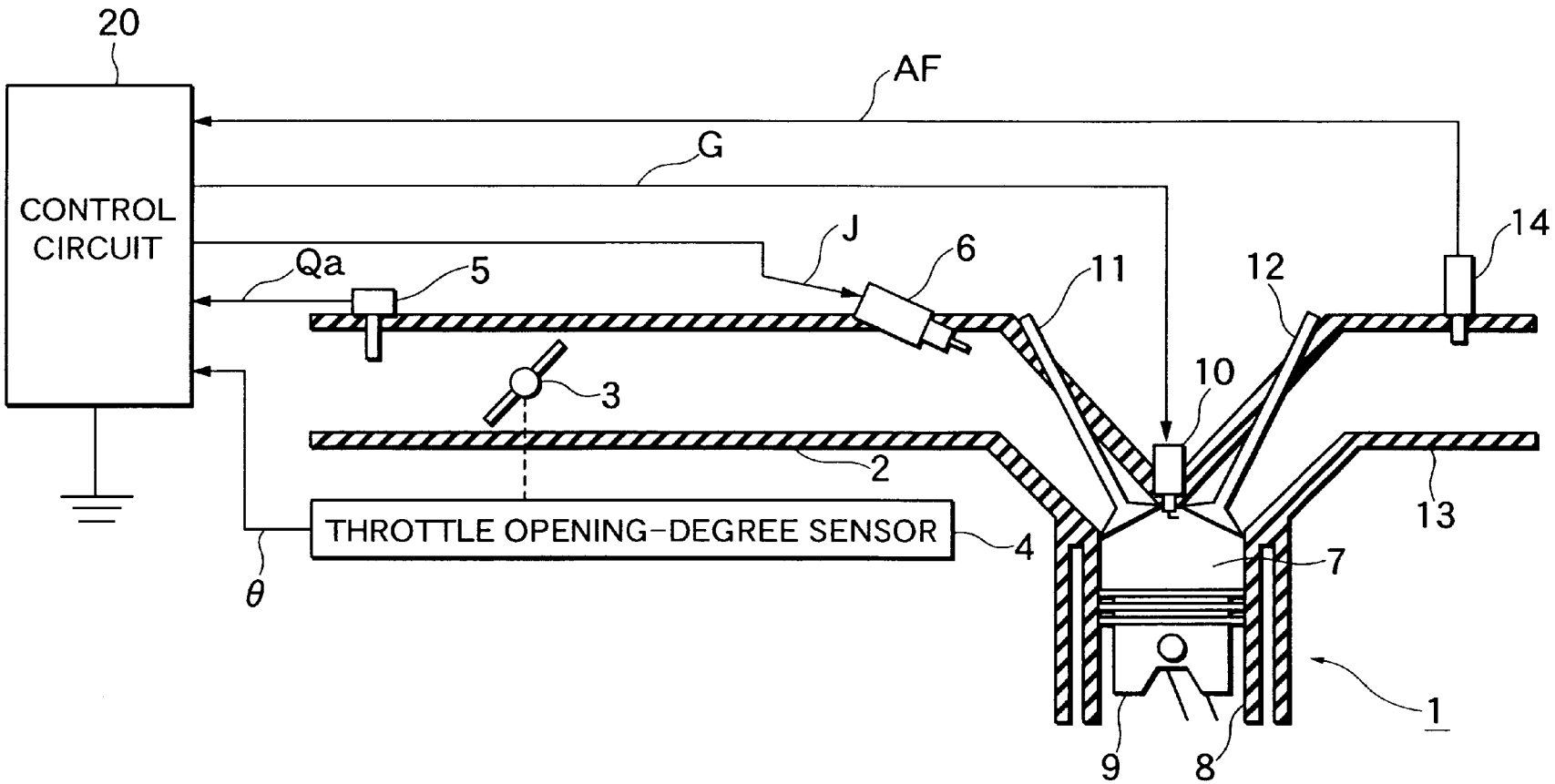
FIG. 5 is a diagram schematically illustrating the constitution of a conventional device for controlling the air-fuel ratio of an internal combustion engine.

FIG. 1 is a functional block diagram schematically illustrating major portions of a control circuit 20A according to the embodiment 1 of the invention. The whole constitution of the embodiment 1 of the invention is as shown in FIG. 5.

In FIG. 1, the control circuit 20A includes target air-fuel ratio setting means 21, air-fuel ratio correction means 22, feedback control condition-determining means 23, feedback control means 24, air-fuel ratio learning means 25 having filter operation means 25F, multipliers 26 to 28 for correcting the amount of fuel (air-fuel ratio), and injector drive means 29.

FIG. 1 illustrates only those constitutions chiefly related to the air-fuel ratio control in the control program set to the ROM in the control circuit 20A.

The air-fuel ratio setting means 21 produces a target air-fuel ratio AFo depending upon the operation conditions (e.g., map data based on engine load and engine rotational speed Ne) of the engine 1.

The air-fuel ratio correction means 22 forms an air-fuel ratio correction coefficient Kaf that varies depending upon the target air-fuel ratio AFo to correct a basic fuel amount Qfb depending upon the target air-fuel ratio AFo.

The air-fuel ratio correction coefficient Kaf is multiplied upon the basic fuel amount Qfb through the multiplier 26 (described later).

The basic fuel amount Qfb is set based upon the intake air amount Qa in the intake pipe 2 and the engine rotational speed Ne, by making reference to the map data that have been so set that the stoichiometric air-fuel ratio $\lambda$ is accomplished.

The feedback control condition-determining means 23 determines the conditions CF for controlling the air-fuel ratio feedback of the engine 1 depending on the operation conditions.

When the control condition CF is permitted (CF=1), the feedback control means 24 executes the feedback control operation so that the air-fuel ratio of the engine 1 is brought into agreement with the target air-fuel ratio AFo.

The air-fuel ratio learning means has the filter operation means 25F that produces a learning correction value Zs(t) obtained by filtering an instantaneous learning correction value found for every predetermined number of times of sampling, in order to find a learning correction value Zs for every operation region based on the control quantity AFc of air-fuel ratio feedback.

The multiplier 26 multiplies the basic fuel amount Qfb by the air-fuel ratio correction coefficient Kaf so as to be corrected, and the multiplier 27 multiplies the target fuel amount (=Qfb×Kaf) after corrected by the control quantity AFc so as to be further corrected.

The multiplier 28 multiplies the target fuel amount (=Qfb×Kaf×AFc) that has been additionally amended by the learning correction value Zs to produce a final target fuel amount Qfo.

The target fuel amount Qfo is multiplied by a correction coefficient (not shown) set depending upon the cooling water temperature Tw of the engine 1 and upon the temperature in the surge tank of the intake pipe 2.

Therefore, when the cooling water temperature Tw is lower than the predetermined temperature, the air-fuel ratio can be enriched to improve combustion in the engine 1 or the density of the air that is taken in can be corrected depending upon the temperature in the surge tank.

The air-fuel ratio correction coefficient Kaf, the control quantity AFc and the learning correction value Zs are used for executing the correction via the multipliers 26 to 28 and are, hence, set to values of about 0.9 to 1.1 (0.5 to 1.5 in terms of a maximum amplitude) with 1 as a central value.

The injector drive means 29 produces an injection signal J for accomplishing a final target fuel amount Qfo, and drives the injector 6 so as to inject fuel in the target fuel amount Qfo.

The operation of the embodiment 1 of the invention shown in FIG. 1 will now be concretely described with reference to FIGS. 2 to 4.

Figure 2:
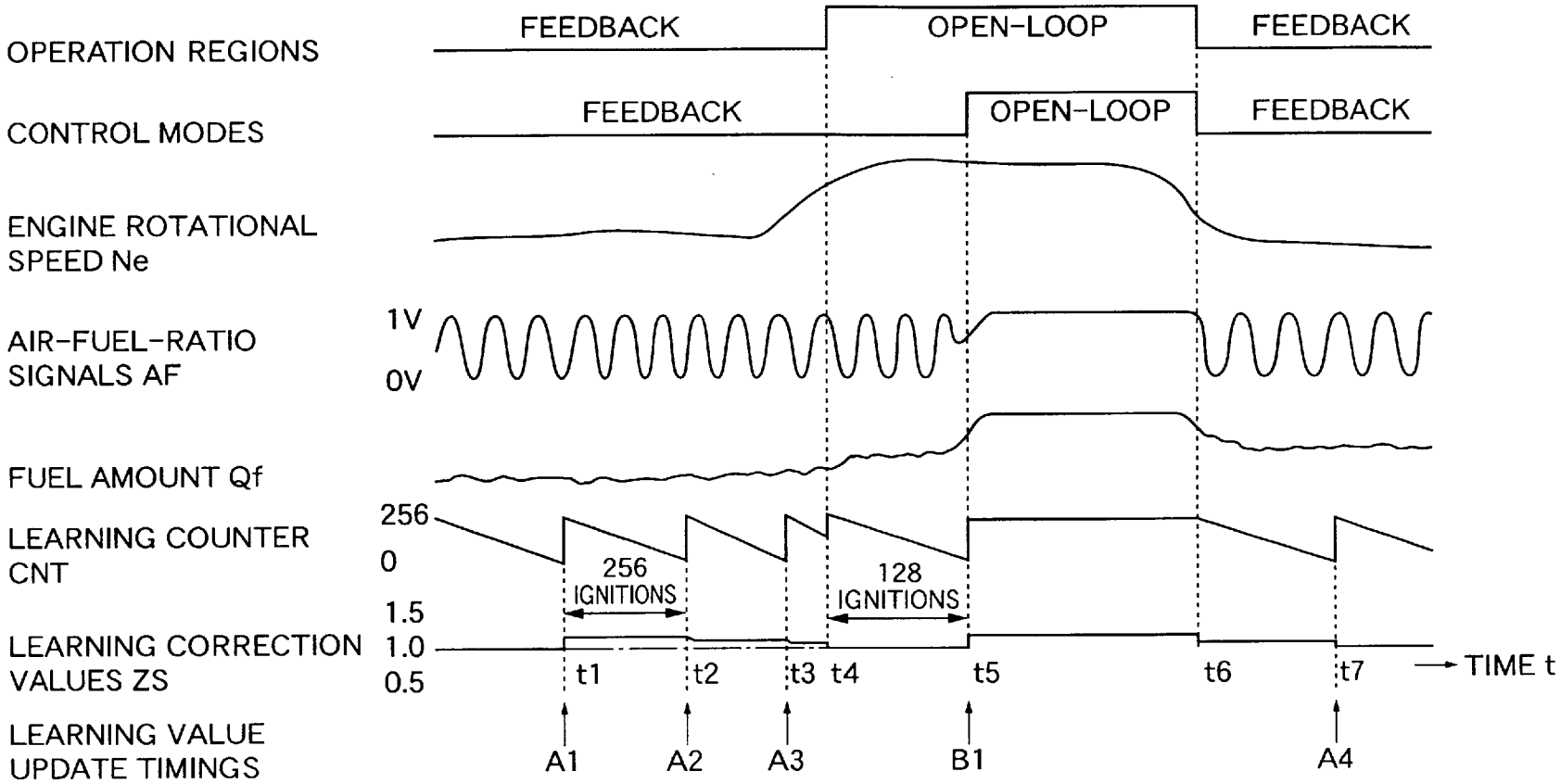
FIG. 2 is a flowchart illustrating the air-fuel-ratio learning operation according to the embodiment 1 of the present invention.
Figure 3:
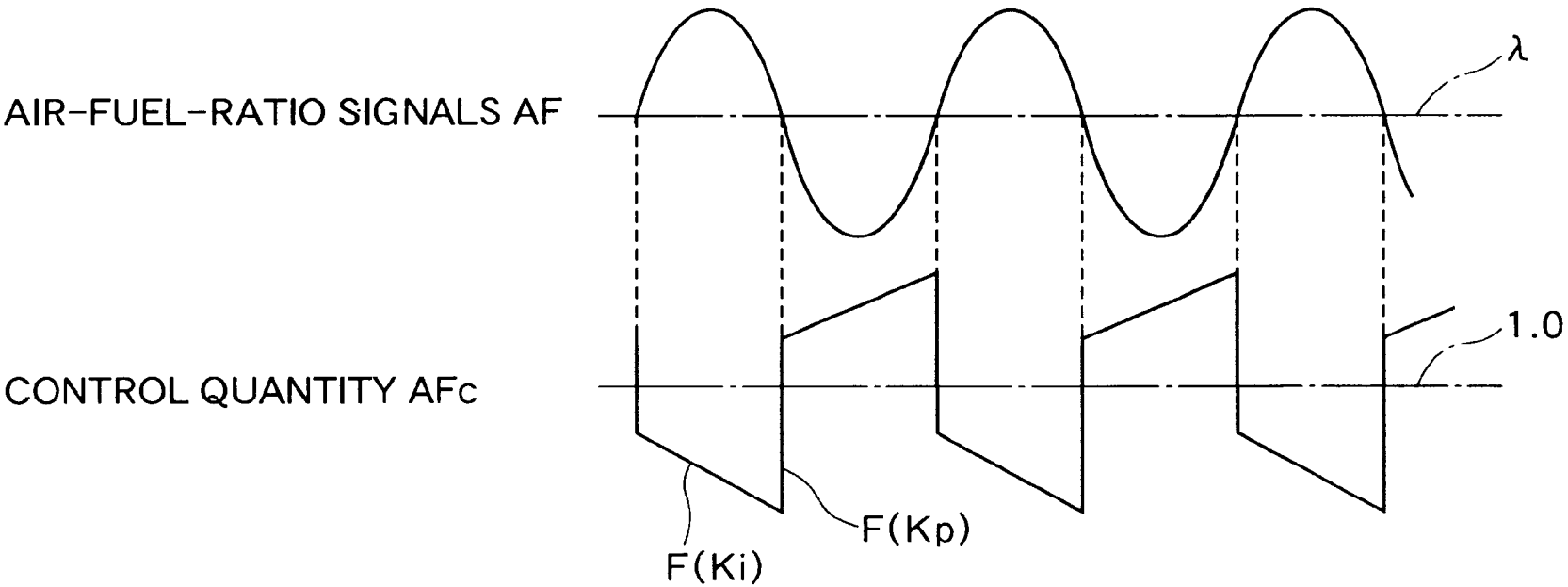
FIG. 3 is a timing chart illustrating, on an enlarged scale, a relationship between the air-fuel-ratio signal and the control quantity according to the embodiment 1 of the present invention.
Figure 4:
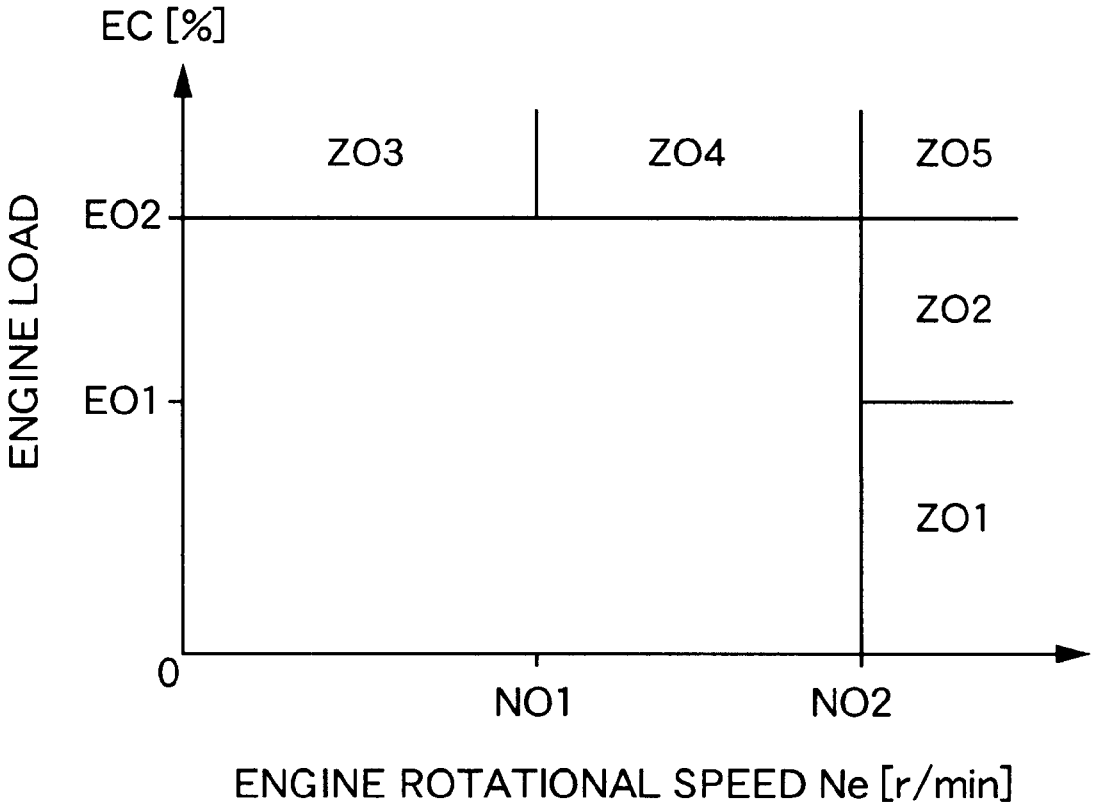
FIG. 4 is a diagram illustrating learning correction values in the open-loop operation region set according to the embodiment 1 of the present invention.

FIG. 2 is a timing chart illustrating the operation in the operation regions according to the embodiment 1 of the invention, FIG. 3 is a timing chart illustrating, on an enlarged scale, a relationship between the air-fuel ratio signal AF and the control quantity AFc, and FIG. 4 is a diagram schematically illustrating learning correction values in the open-loop operation region obtained according to the embodiment 1 of the present invention.

FIG. 2 illustrates operation regions, practical control modes, engine rotational speeds Ne, air-fuel ratio signals AF, fuel amounts Qf, learning counter CNT, learning correction values Zs, and learning value-updating timings A1 to A4 and B1.

In FIG. 2, a period of up to time t4 is a feedback operation region, a period of from time t4 to time t6 is an open-loop operation region, and a period of after time t6 is a feedback operation region.

Further, a period of up to time t5 is a feedback control period, a period of from time t5 to time t6 is an open-loop control period, and a period of after time t6 is a feedback control period.

Therefore, the feedback control is executed in the period of from time t4 to time t5 though it is in the open-loop operation region.

The open-loop operation region (t4 to t6) is set at the time when, for example, the engine rotational speed Ne is increasing.

The air-fuel ratio signal AF periodically changes over a range of from 0 V to 1 V in the feedback control period, and is fixed to 1 V (rich side) in the open-loop control period (t5 to t6).

The fuel quantity Qf is fixed to the increasing side during the open-loop control period.

The learning counter CNT counts down the initially set value (number of times of sampling for finding the learning correction value Zs). In the feedback control period, 256 times of ignition cycles are initially set as the number of times of sampling and in the feedback control period in the open-loop operation region, 128 times of ignition cycles are initially set as the number of times of sampling.

The learning correction value Zs is updated and set at every learning value update timing A1 to A4 and B1 by a value obtained by filtering the instantaneous learning correction value found by sampling the control quantity AFc (see FIG. 3) that periodically varies within a range of a maximum amplitude of from 0.5 to 1.5. At times t4 and t6, the learning correction value Zs is changed, due to a change in the operation region, into the learning correction values that have been stored being corresponded to the operation regions irrespective of the timings for updating the learning correction value Zs.

At the learning value update timing B1, the learning correction value Zs is updated by the feedback control during the open-loop operation region.

In the feedback control period (t4 to t5) during the open-loop operation region, the learning correction value Zs is fixed to "1.0" if it has not been learned in the preceding open-loop operation region.

Referring to FIG. 3, in a period in which the air-fuel-ratio signal AF is on the side more rich than the stoichiometric air-fuel ratio λ, the control quantity AFc of air-fuel ratio feedback is set to a value smaller than "1.0" to decrease the fuel amount Qf and in a period in which the air-fuel-ratio signal AF is on the side more lean than the stoichiometric air-fuel ratio λ, the control quantity AFc of air-fuel ratio feedback is set to a value larger than "1.0" to increase the fuel amount Qf.

The inclination of gradually decreasing (gradually increasing) waveform of the control quantity AFc corresponds to the integration coefficient F (Ki), and the amplitude of waveform at a portion where the polarity is inverted in the control quantity AFc corresponds to the proportional coefficient F (Kp).

In FIG. 4, the abscissa represents the engine rotational speed Ne [r/min] and the ordinate represents the engine load (filling efficiency) EC [%]. The open-loop operation region is sectionalized by the engine operational speeds NO1 and NO2 and by the engine loads EO0 to EO2, and the learning correction values ZO1 to ZO5 are set for the open-loop operation regions.

The learning correction values ZO1 to ZO5 of FIG. 4 are obtained by sampling the ignition cycles (128 times) and are updated at the learning value update timing B1.

Figure 6:
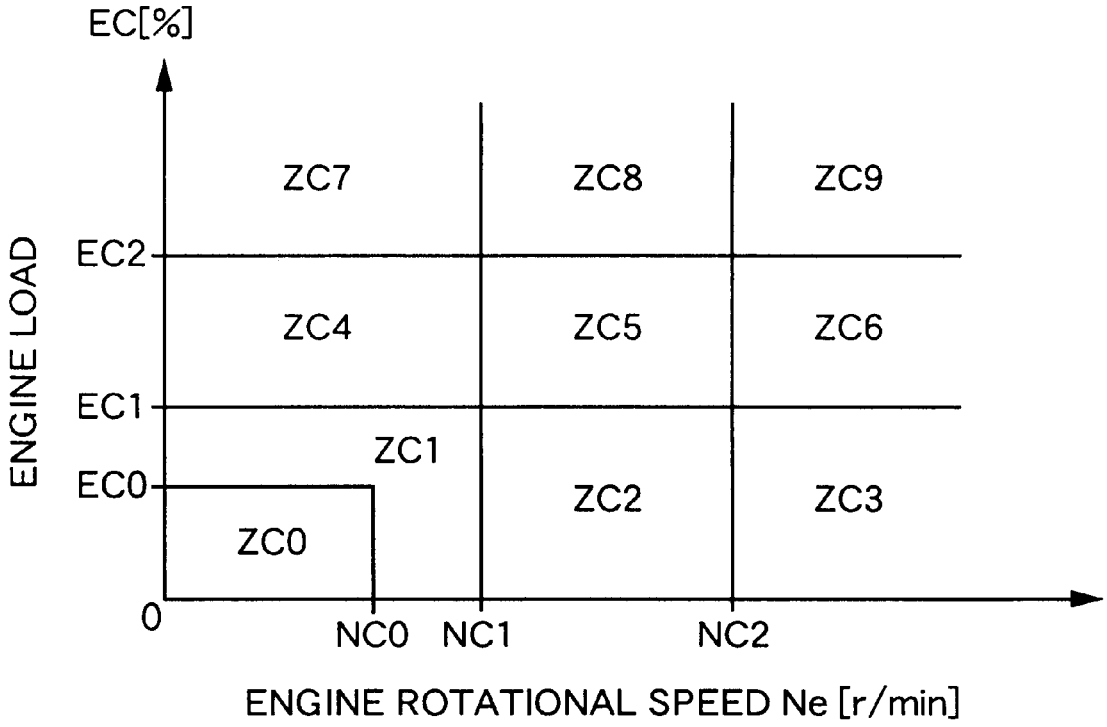
FIG. 6 is a diagram illustrating learning correction values in the feedback (closed-loop) operation region set by the conventional device for controlling the air-fuel ratio of the internal combustion engine.

The learning correction values Zs in the feedback operation region are obtained in the same manner as described above (see FIG. 6).

Described below are the operations of the feedback control means 24 and of the air-fuel ratio learning means 25 while giving attention to the feedback control period (t4 to t5 in FIG. 2) in the open-loop operation region.

When the control condition CF of the air-fuel ratio feedback is not permitted (CF=0), the feedback control means 24 temporarily executes the feedback control operation only in the ignition cycles of 128 times in the period t4–t5 in the open-loop operation region.

At this moment, the air-fuel ratio learning means 25 finds the learning correction values Zs in the open-loop operation region in compliance with the following formula (1) by using the filter operation means 25F, $$Zs(t)=Zs(n-1)+\alpha\times\{Zs(n)-1.0\} \quad (1)$$

Here, in FIG. (1), Zs(t) is a learning correction value operated at the update timing of this time, Zs(n−1) is a learning correction value operated at the update timing of the previous time, and Zs(n) is an instantaneous learning correction value found at the update timing of this time.

Further, α is a filter coefficient which is set to a value within a range of from 0 to 1.0 depending upon the reflection factor of the instantaneous learning correction value Zs(n) of this time.

Since a value obtained by subtracting 1.0 from the instantaneous learning correction value Zs(n) of this time is reflected by the filter processing, the learning correction value Zs(t) increases when Zs(n)>1.0 and decreases when Zs(n)<1.0.

The learning correction values Zs(t) calculated in compliance with the formula (1) are set as learning correction values ZO1 to ZO5 in FIG. 4 at the update timing B1.

The learning correction values ZO1 to ZO5 are used for correcting the fuel amount Qf (air-fuel ratio) depending upon the operation regions in the open-loop control period t5–t6.

Thus, even after the feedback (closed-loop) operation region based upon the air-fuel ratio signal AF has shifted into the enriched (open-loop) operation region for protecting the catalytic converter and for maintaining the output of the engine 1, the air-fuel ratio learning is executed by the temporary feedback control operation, making it possible to effect the correction based upon highly precise learning correction values in the open-loop control period.

Owing to the learning correction values ZO1 to ZO5 (see FIG. 4) that vary depending upon the practical operation regions, therefore, it is allowed to highly precisely control the air-fuel ratio even in the open-loop control period.

As shown in FIG. 4, furthermore, the open-loop operation region is divided into plural regions depending upon the engine rotational speed Ne and the engine load EC, and the learning correction values ZO1 to ZO5 are set for the plural regions. It is therefore made possible to finely control the air-fuel ratio even in the open-loop operation region.

That is, in the feedback operation region, the air-fuel ratio is controlled in a customary manner by compensating dispersion in the engine 1 and in various control equipment. In the open-loop operation region, therefore, variance in the enriched air-fuel ratio is suppressed irrespective of the operation conditions.

This makes it possible to suppress deterioration in the properties of the exhaust gases that results when the air-fuel ratio becomes too rich in the open-loop control period without the need of using a linear air-fuel ratio sensor but using an ordinary air-fuel ratio sensor 14.

It is further allowed to suppress damage to the catalytic converter that results when the air-fuel ratio is not enriched to a sufficient degree in the open-loop control period, without the need of using an additional catalyst temperature sensor.

Further, the number of times of sampling for learning in the open-loop operation region is set to 128 ignition cycles, which is smaller than the number of times of sampling (256 ignition cycles) in the feedback operation region, making it possible to quickly obtain learning correction values in the open-loop operation region avoiding the occurrence of various inconveniences (damage to the catalytic converter, lack of engine output, etc.).

In the above period t4–t5, the stoichiometric air-fuel ratio $\lambda$ is forcibly fed back as a target value in order to obtain learning correction values in the open-loop operation region despite this period is in the operation region where the feedback must be inhibited. It is therefore desired that the period t4–t5 ends within a period of time which is as short as possible.

As described above, therefore, the number of times of sampling for learning is set in the open-loop operation region separately from the number of times of sampling set in the feedback operation region, in order to maintain air-fuel ratio control performance in the feedback operation region, to prevent the catalytic converter from being damaged by the forced feedback control by ending the air-fuel ratio learning in the open-loop operation region within a short period of time, and to maintain output of the engine 1.

Embodiment 2.

Though the filter coefficient $\alpha$ of the filter operation means 25F was not concretely described in the above embodiment 1, it is also allowable to variably set the filter coefficient a depending upon the feedback operation region and the open-loop operation region.

For example, the filter coefficient $\alpha$ in the ordinary feedback operation region may be set to a relatively small value, and the filter coefficient $\alpha$ in the open-loop operation region (period t4–t5) may be set to a value larger than the value in the feedback operation region.

This enables the learning correction value Zs(t) in the open-loop operation region to quickly follow the instantaneous learning correction value Zs(n) found at the update timing.

Embodiment 3.

Though the embodiment 1 did not refer to how to set the proportional coefficient F (Kp) and the integration coefficient F (Ki) concerned to the control quantity AFc in the feedback means 24, it is allowable to variably set the proportional coefficient F (Kp) and the integration coefficient F (Ki) depending upon the feedback operation region and the open-loop operation region.

For example, the proportional coefficient F (Kp) and the integration coefficient F (Ki) in the ordinary feedback operation region may be set to relatively small values, and the proportional coefficient F (Kp) and the integration coefficient F (Ki) in the open-loop operation region (period t4–t5) may be set to values larger than the values in the feedback operation region.

In the open-loop operation region, therefore, the inclination of the gradually decreasing waveform and the inclination of the gradually increasing waveform of control quantity AFc increase and, besides, the amplitude of waveform increases at a portion where the polarity is inverted. Accordingly, the air-fuel-ratio signal AF follows the control quantity AFc more quickly in the open-loop operation region, making it possible to further shorten the air-fuel-ratio learning period t4–t5 and, hence, to reliably avoid the occurrence of inconvenience in the engine 1.

It needs not be pointed out that the combination of the above-mentioned embodiments 1 to 3 makes it possible to obtain their actions and effects simultaneously.

What is claimed is:

1. A device for controlling an air-fuel ratio of an internal combustion engine comprising:

an injector for injecting an amount of fuel into an internal combustion engine;

an air-fuel-ratio sensor installed in an exhaust pipe of said internal combustion engine for detecting a stoichiometric air-fuel ratio; and a control circuit for controlling said injector based upon operation conditions of said internal combustion engine and an air-fuel-ratio signal generated by said air-fuel-ratio sensor;

wherein said control circuit includes:

air-fuel-ratio correction means for correcting said amount of fuel depending upon a target air-fuel ratio that varies according to said operation conditions;

feedback control condition-determining means for determining conditions for controlling the air-fuel ratio feedback of said internal combustion engine depending upon said operation conditions;

feedback control means for controlling the air-fuel ratio of said internal combustion engine so as to come into agreement with said target air-fuel ratio in a feedback operation region where said control conditions are permitted; and air-fuel-ratio learning means for determining learning correction values for every operation region based on a control quantity of said feedback control means;

wherein in an open-loop operation region where said control conditions are not permitted, said feedback control means temporarily executes a feedback control operation, and said air-fuel-ratio learning means determines said learning correction values in said open-loop operation region during said feedback control operation.

2. A device for controlling the air-fuel ratio of an internal combustion engine according to claim 1, wherein said air-fuel-ratio learning means changes a number of times of sampling for determining said learning correction values depending upon said feedback operation region and said open-loop operation region.

3. A device for controlling the air-fuel ratio of an internal combustion engine according to claim 2, wherein said air-fuel-ratio learning means sets the number of times of sampling for determining the learning correction values in said open-loop operation region to be smaller than the number of times of sampling for finding the learning correction values in said feedback operation region.

4. A device for controlling the air-fuel ratio of an internal combustion engine according to claim 1, wherein said feedback control means changes a proportional coefficient and a integration coefficient of said control quantity depending upon said feedback operation region and said open-loop operation region.

5. A device for controlling the air-fuel ratio of an internal combustion engine according to claim 4, wherein said feedback control means sets the proportional coefficient and the integration coefficient in said open-loop operation region to be larger than the proportional coefficient and the integration coefficient in said feedback operation region.

6. A device for controlling the air-fuel ratio of an internal combustion engine according to claim 1, wherein said air-fuel-ratio learning means includes filter operation means for executing filtering when said learning correction value is updated.

7. A device for controlling the air-fuel ratio of an internal combustion engine according to claim 6, wherein said air-fuel ratio learning means changes a filtering coefficient of said filter operation means depending upon said feedback operation region and said open-loop operation region.

8. A device for controlling the air-fuel ratio of an internal combustion engine according to claim 7, wherein said air-fuel-ratio learning means sets the filter coefficient in said open-loop operation region to be larger than the filter coefficient in said feedback operation region.

9. A device for controlling the air-fuel ratio of an internal combustion engine according to claim 1, wherein said air-fuel-ratio learning means divides said open-loop operation region into a plurality of regions depending upon a rotational speed and a load of said internal combustion engine, and sets said learning correction values for said divided regions.

* * * * *